United States Patent [19]

Meyers

[11] 3,972,157

[45] Aug. 3, 1976

[54] BAG HOLDING AND OPENING APPARATUS

[76] Inventor: Sanford Meyers, 340 Croaton St., Lake Ronkonkoma, N.Y. 11779

[22] Filed: Mar. 24, 1975

[21] Appl. No.: 561,296

[52] U.S. Cl. ..... 53/384; 53/390

[51] Int. Cl.[2] ..... B65B 43/26; B65B 67/00

[58] Field of Search ..... 53/188–190, 53/384–386, 390, 391; 248/95, 99, 101; 312/42, 50

[56] References Cited

UNITED STATES PATENTS

| | | | |
|---|---|---|---|
| 2,950,589 | 8/1960 | Litchard | 53/385 X |
| 3,213,588 | 10/1965 | Peterson | 53/188 X |
| 3,391,519 | 7/1968 | Keenan et al. | 53/189 |
| 3,412,522 | 11/1968 | Schorer | 53/189 |
| 3,556,316 | 1/1971 | Marasso et al. | 53/385 X |
| 3,564,814 | 2/1971 | Graveley | 53/391 X |
| 3,626,662 | 12/1971 | Graveley | 53/391 X |
| 3,685,252 | 8/1972 | Wouda | 53/189 |
| 3,763,628 | 10/1973 | Bodolay | 53/189 |
| 3,777,439 | 12/1973 | Fried | 53/384 X |
| 3,782,073 | 1/1974 | Musser | 53/384 |

*Primary Examiner*—Robert L. Spruill
*Attorney, Agent, or Firm*—Ashlan F. Harlan, Jr.

[57] ABSTRACT

Bag holding and opening apparatus that comprises a container adapted to hold a stack of folded paper bags on a platform which is spring supported and by which the stack of bags are pressed against an abrasive faced roller that engages the top bag at a point adjacent the thumb hole at the open end thereof and frictionally holds said bag, whereby when the bottom end of said top bag is pulled outwardly the bag is opened.

5 Claims, 6 Drawing Figures

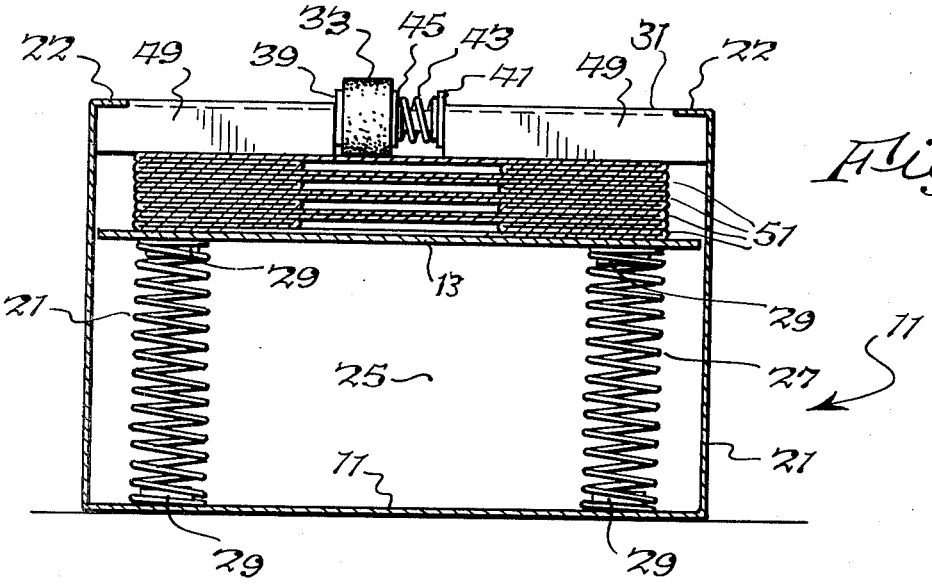
Fig. 4.
Fig. 5.
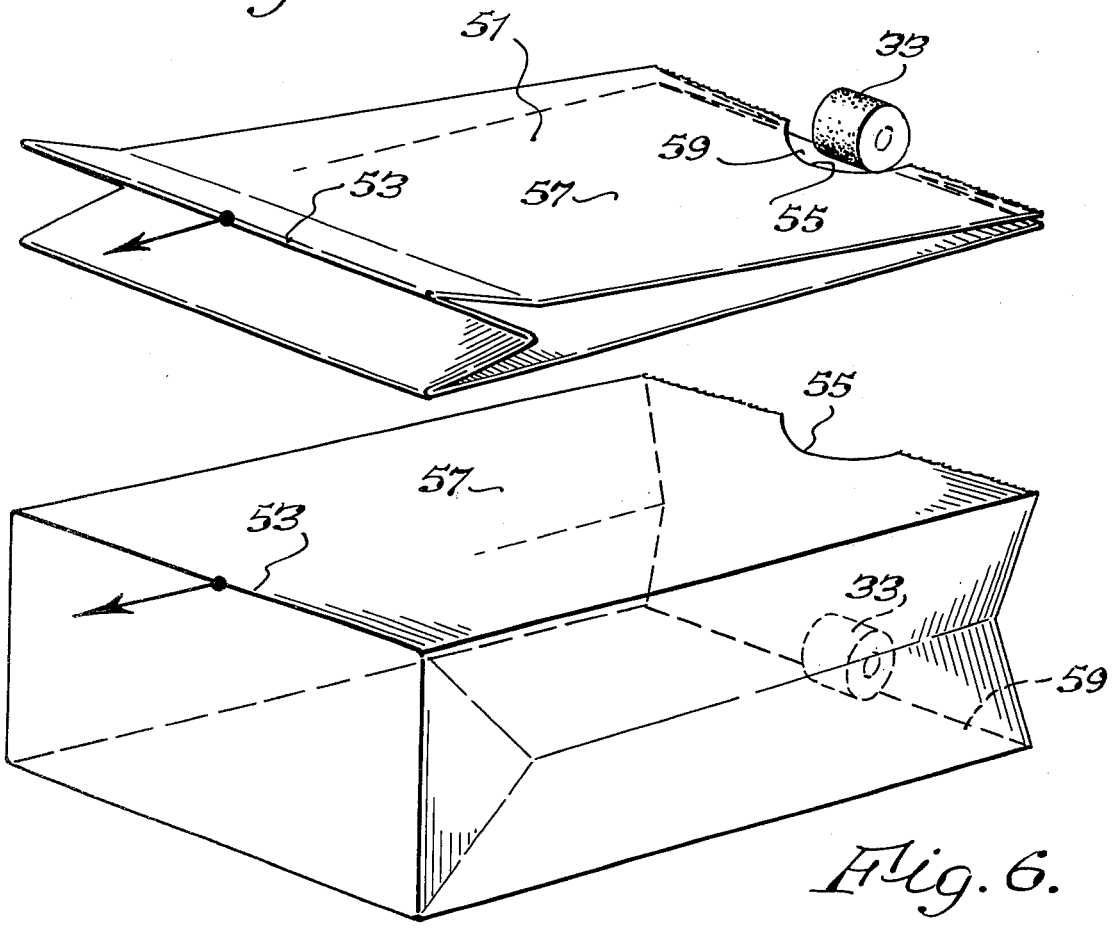
Fig. 6.

BAG HOLDING AND OPENING APPARATUS

BACKGROUND OF THE INVENTION

The invention of the present application relates to apparatus for holding paper bags and opening such bags when required. It is of particular interest in connection with checkout counters in supermarkets.

In checking out customers in supermarkets, the purchased items are usually removed from a cart to a counter or moving belt and after the prices of the items have been rung up on a cash register, are placed in a large paper bag or bags. This bagging may be done by the cashier or by a separate person, a "bagger". In most supermarkets, the folded paper bags are merely piled in a stack. Hence, they may shift position or fall from the stack and thereby make it more difficult and time consuming to grasp and open the bag properly, position it, and start to place purchased items therein. A number of attempts have been made to make it easier and quicker to grasp and open a bag for loading. See, for example, U.S. Pat. Nos. 3,777,439; 3,564,814; and 3,782,073.

It is an object of the present invention to provide improved apparatus that holds stacked paper bags in such manner that they open as they are removed from the apparatus. Thus, time is saved at the checkout counter and the store operation is more efficient.

SUMMARY OF THE INVENTION

The above-mentioned object is achieved by providing a container for a stack of folded paper bags, said container having a spring supported platform on which the bags rest and an abrasive-faced roller that is frictionally loaded by a spring. The roller is resiliently held against the top bag of the stack and engages said top bag adjacent the thumb hole at the open end of said bag, whereby the bag is releasably held to cause it to open as the bottom of the bag is pulled from the container.

SHORT DESCRIPTION OF THE DRAWINGS

FIG. 4 is a slightly enlarged vertical sectional view taken on line 4—4 of FIG. 1; and FIGS. 5 and 6 are diagrammatic views which illustrate the action as a bag is removed from the apparatus to open it.

The Invention

From the drawings, it will be apparent that the apparatus of the invention, in a simple embodiment, may comprise a container 11 provided with a resiliently mounted plate or platform 13 vertically movable within said container and adapted to hold a stack of bags, and a partial cover 15 secured on one end of the container 11.

Figure 1:
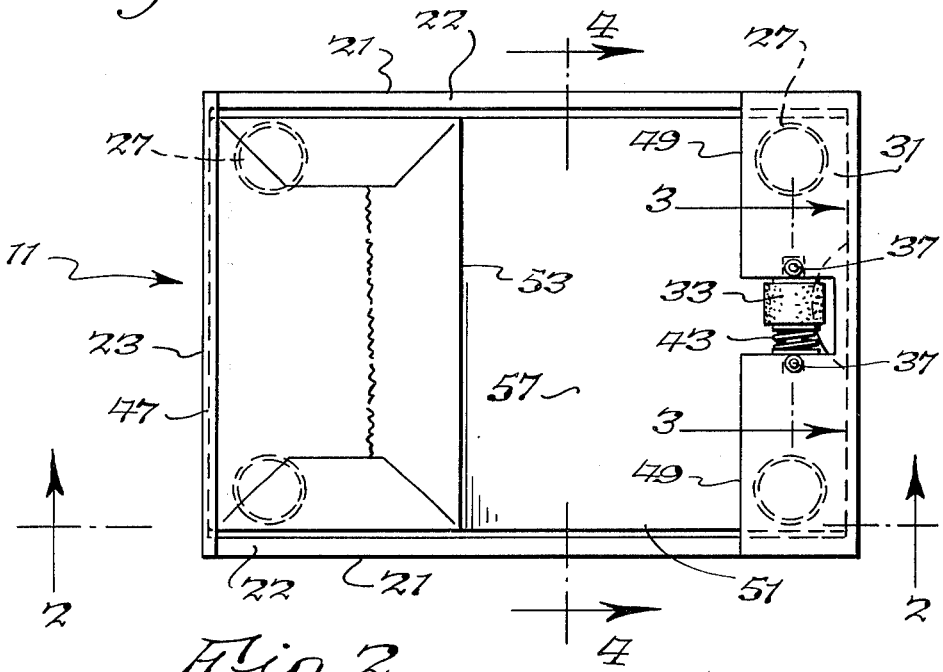
FIG. 1 is a top plan view of apparatus, according to the invention, containing a stack of folded paper bags.

The terms "upper", "lower", "top", "bottom", "right", "left" "above", "below", "vertical", and "horizontal", and similar terms of position and/or direction as used hereinafter refer to the illustration in FIGS. 1 and 2, but are used only for convenience in description and/or reference. Such terms should not be so construed as to imply a necessary positioning of the structure or portions thereof, or to limit the scope of this invention. It should be noted that the showing of the paper bags in the several views is somewhat diagrammatic in that the thickness of the bags and the spaces between sheets or webs are enlarged for clarity.

The container 11, as shown by the drawings, is a rectangular, boxlike structure comprising a bottom 19, identical sides 21 having inwardly directed top flanges 22, and ends 23 and 25. It is essentially open at the top and is preferably formed of folded sheet metal with suitably soldered or brazed seams. If desired, however, the container can be constructed of a suitable molded plastic, or of wood.

The plate or platform 13 provided in the container 11 is preferably the same shape as the bottom 19 of the container, but slightly smaller in both length and breadth than the container bottom 19 to permit its free vertical movement in the container. The platform 13 is preferably formed of sheet metal and may be merely a sheet, as shown. If desired, however, depending, stiffening flanges (not shown) can be provided on the platform at its ends and/or along its sides. The plate of platform 13 is supported resiliently on the container bottom 19 by a plurality of coiled compression springs 27, one such spring being located adjacent each corner of the plate. Appropriate locating devices, such as studs or bosses 29, can be provided on the container bottom 19 and on the bottom face of platform 13 to maintain the springs in place. Such studs or bosses may be attached in any suitable manner.

A partial cover 31 is provided for the container 11. This cover extends inwardly from the end 25 of the container and preferably is formed by bending inwardly an extension of container end 25, although it may be formed as a separate component and secured to the sides 21 of the container by suitable means (not shown). Mounted on the cover 31 adjacent the middle thereof is an abrasive-faced wheel or roller 33 adapted to rotate on a stationary shaft 35 arranged parallel to the end 25 of the container 11. The shaft 35 is removably secured to the cover 31 by screws 37. Thrust washers 39 and 41 are provided on the shaft 35 adjacent the screws 37. The wheel 33 engages the washer 39 and is pressed against said washer by a coiled compression spring 43 that encircles the shaft 35 and bears against the thrust washer 41 and against a third washer 45 that contacts the wheel or roller 33. Thus, the wheel is frictionally loaded to resist rotation.

Folded, large paper bags 51 are stacked on the plate or platform 13 in such fashion that the closed ends of the bags are held under the inwardly directed flange 47 at the top of the container end 23, while the bags are held down adjacent their open ends by a downwardly directed flange 49 on the cover 31 and by the roller or wheel 33 resting thereon. When loaded with a stack of paper bags, the apparatus above described makes it possible to pull a bag from the stack and have it open as it is withdrawn from the container. This is accomplished as described below.

Figure 2:
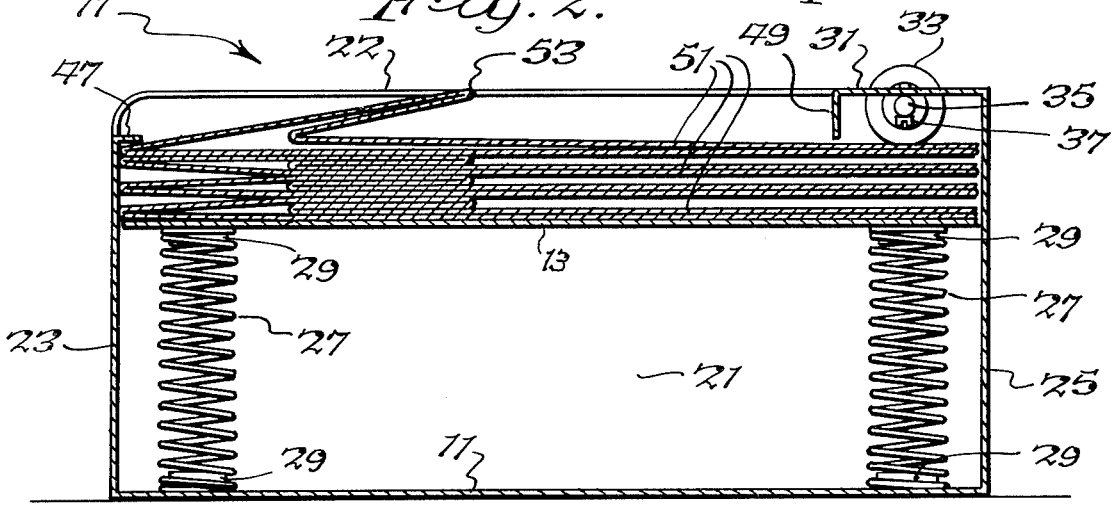
FIG. 2 is a slightly enlarged vertical sectional view taken on line 2—2 of FIG. 1.
Figure 3:
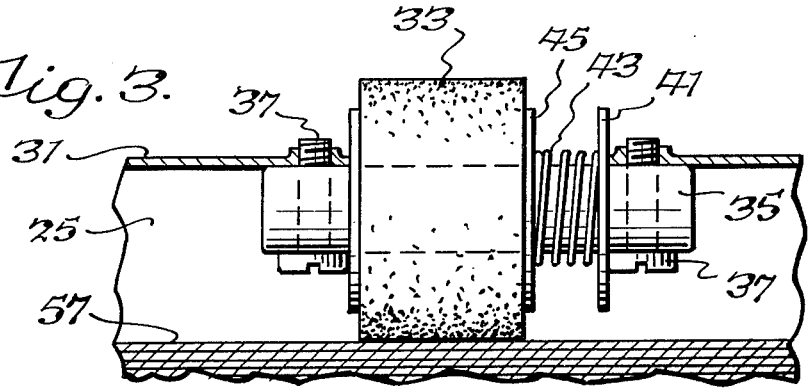
FIG. 3 is an enlarged detail view of a portion of the apparatus of the invention, the view being taken along line 3—3 of FIG. 1.

When the container 11 is loaded, the stack of paper bags 51 therein is arranged substantially as shown in FIG. 2, i. e. with the open ends of the bags at the right end of the container 11 under the roller or wheel 33 and with the bag bottoms folded over on the bags. When it is desired to remove a bag from the container, the uppermost, exposed edge 53 of the folded bottom of the top bag is grasped, preferably at about the middle thereof and pulled in the direction indicated by the arrow in FIG. 5. This tends to straighten out the bag bottom since the bag as a whole is restrained from movement in the direction of the arrow by the resistance of the roller or wheel 33 to rotation and by the flange 47. However, a continued pull on the edge 53 will cause the bag to move and the roller 33 to rotate. But since the wheel 33 is so located that it engages the open ends of the bags 51 at the point where the thumb holes 55 are provided on the top sides 57 of the bags, the lower side 59 of the bag will be restrained by the roller longer than the top side 57 and a continued pull on the edge 53 in the direction of the arrow (FIG. 5) will therefore result in the bag being pulled from the container in open condition as shown in FIG. 6, ready to be filled with purchased items.

It will be understood that the operation of the present novel apparatus depends upon the bags being tightly gripped adjacent their open ends by the abrasive-faced roller or wheel 33. Consequently, the springs 27 should be strong. In actual practice, a pressure against the bottom of the bag stack of about 190 kg may be used and is preferred. The resistance of the abrasive-faced wheel 33 to rotation may be varied by varying the pressure exerted by the spring 43 employed. This is preferably within the range from about 20 kg to about 60 kg. The wheel or roller 33 may be molded of abrasive grain with a suitable bond or may be formed by cementing abrasive coated fabric or paper on the periphery of a roller made of wood, metal, or suitable plastic material.

The novel apparatus of the present invention is efficient and requires little attention or maintenance. Reloading the container with bags is easily accomplished. It will be noted that since the apparatus does not rely upon gravity, it can be used in any position. Thus, the container may rest on a counter or may be mounted on the side or bottom of the counter. Obviously, containers may be of any desired size so that bags of various sizes may be used.

It will be understood that various modifications and variations in the described structure can be made without departing from the spirit of the invention. Consequently, it is intended that the invention shall be interpreted as broadly as permitted by the appended claims.

I claim:

1. Apparatus for holding and manually opening folded bags which comprises: an independently portable, rectangular container adapted to hold a stack of folded paper bags, each of said bags having a thumb hole in the upper wall thereof and being folded with the bag bottom on the upper surface thereof, said container permitting manual removal of the top bag from said stack; a platform resiliently mounted in said container for vertical movement therein adapted to support said stack of bags, means at the ends of said container for restraining said stack of bags from upward movement, said means at one end of said container comprising a transverse inwardly projecting flange adapted to engage the closed end of the top bag in said stack and said means at the other end of said container comprising a roller carried by said container adapted to engage the top bag on said stack at a point thereon aligned with the thumb hole in said bag and adjacent the open end thereof, whereby the top bag on said stack may be disengaged from said flange, opened, and removed empty from said container, by grasping the folded bottom thereof and pulling it longitudinally away from said roller.

2. Apparatus as defined in claim 1 wherein said platform is resiliently mounted on springs bearing against the bottom of said platform adjacent the corners thereof, whereby the stack of bags is resiliently pressed against said restraining means.

3. Apparatus as defined in claim 1 wherein said roller is abrasive-faced.

4. Apparatus as defined in claim 1 wherein said roller is frictionally loaded to resist rotation.

5. Apparatus as defined in claim 2 wherein said roller is abrasive-faced and is frictionally loaded to resist rotation by a spring coaxially arranged with said roller.

* * * * *